United States Patent [19]

Phillips

[11] 4,144,420

[45] Mar. 13, 1979

[54] AUTOMATIC LIGHT SWITCHING SYSTEM

[76] Inventor: Raymond N. Phillips, 835 Tropical Cir., Sarasota, Fla. 33581

[21] Appl. No.: 855,392

[22] Filed: Nov. 26, 1977

[51] Int. Cl.[2] ..... H01H 43/02

[52] U.S. Cl. ..... 200/51 R; 200/33 R; 200/38 FB; 307/141

[58] Field of Search ..... 200/51 R, 51.1, 33 R, 200/38 FB; 307/141; 339/14 P, 153, 154 A, 166

[56] References Cited

U.S. PATENT DOCUMENTS

| | | | |
|---|---|---|---|
| 3,495,205 | 2/1970 | Ricci | 339/14 P |
| 3,828,224 | 8/1974 | Hulshizer | 200/33 RX |
| 3,889,132 | 6/1975 | Vreeland | 307/141 |
| 4,001,527 | 1/1977 | Hulshizer | 200/33 R X |
| 4,019,797 | 4/1977 | Praml | 339/14 P |

*Primary Examiner*—Herbert F. Ross

*Attorney, Agent, or Firm*—Duckworth, Hobby, Allen & Pettis

[57] ABSTRACT

An automatic light switching system including a receptacle for an automatic timer whereby the circuit including the receptacle will be operated in response to predetermined settings of the timer. A manual on-off switch is also included so that the circuit can be operated independently of the timer. The light switching system specifically comprises a modification for the circuit's wiring and an adapter whereby standard, commercially-available timers may be utilized to regulate the circuit's operation in predetermined fashion.

5 Claims, 13 Drawing Figures

AUTOMATIC LIGHT SWITCHING SYSTEM

BACKGROUND OF THE INVENTION

1. Field of the Invention

The present invention relates to an automatic light switching system of the type primarily intended for use in operating an electrical light circuit. By virtue of the construction of the light switching system, lights, or other work loads electrically connected to the circuit to be operated, may be energized in a predetermined fashion in response to signals from an automatic timer.

2. Description of the Prior Art

Various forms of and constructions for automatic timers utilized to operate electrical appliances are well known in the prior art. Briefly stated, these timing devices comprise electric clock, or timer, circuits energized by 115 volt AC current from a wall outlet. The timer is plugged into the outlet and on-off sequences are set by a dial on the timer's face. The timer then further includes an outlet where the electrical cord of some appliance, such as a coffee pot or a light, is inserted. Then, dependent upon the setting on the timer's dial, a circuit within the timer opens and closes to allow current to flow through the timer's outlet into the appliance. Generally speaking, it may be said that two embodiments of such timers are available on the market today. One timer is sold under the mark General Electric, and a second type is sold under the mark Intermatic. The distinctions between the two types of timers are primarily a matter of internal wiring and not of ultimate function.

However, as is apparent from the description in the preceding paragraph, these timers are utilized to regulate the on-off condition of some external appliance. That is to say, the timers do not regulate the flow of current through the circuit into which they are inserted, and from which the timer receives its operating current. While this is of no real concern with regard to the operation of a coffee pot, it is apparent that there is a great need for some means of controlling an existing electrical circuit such as a home's external lights.

In recognition of this need there are prior art devices which are capable of controlling in a timed fashion, an electrical circuit. One immediate solution to the problem is the installation of a timing control as the actual switch means for the circuit. However, not only might this eliminate the use of the circuit except by the timing device, it must also be built into the circuit. This necessarily increases the cost of such a device and effectively restricts its utility to new installations.

Another solution is illustrated in U.S. Pat. No. 3,889,132 to Vreeland. That patent teaches a construction for a timer assembly comprising a specifically constructed plug casing including a timer to be used in combination with a modified wall receptacle. Though quite suitable for its intended purpose, the Vreeland device is somewhat limited by the fact that a special plug casing/timer must be utilized.

Accordingly, it is clear that there is a great need in the art for an automatic switching system which is easily adaptable for use in existing electrical circuits. Such a system would require only minor modification of the circuit to be operated and would, preferably, utilize as the timing mechanism a commercially-available timer device. Such a system would not only be relatively inexpensive to install, but would also provide great flexibility of use.

SUMMARY OF THE INVENTION

The present invention relates to an automatic light switching system of the type primarily intended for use in operating an electrical circuit. Most simply stated the light switching system comprises three elements: a manual switch and wall receptacle, a standard, commercially available automatic timer, and an adapter disposable in conductive relation between the timer and the wall receptacle. At this point attention is invited to the fact that today's market includes automatic timers of two distinct varieties.

Commercially-available automatic timers are classifiable in one of two categories depending upon their internal circuits. Inasmuch as these timers are utilized to regulate the operation of an alternating current circuit, they all include two prongs for insertion into a wall receptacle to receive power for operating the timer. The distinction between the two tpes resides in which of the two prongs is "hot." That is to say, which of the two prongs initially receives the alternating current. The two types of timer circuits are illustrated in the marketplace by, on the one hand, General Electric brand timers and, on the other hand, Intermatic brand timers. The circuit distinction between the two brands resides merely in whether it is the right or the left prong of the timer that inserts into the corresponding "hot" side of the receptacle. In keeping with the industry standard of two embodiments for the internal circuitry of timers, the present automatic light switching system also contemplates two embodiments. Of course, the distinction between the two embodiments is primarily one of wiring and not of structure, per se. The remainder of this summary description of the invention will be given with specific regard to the first embodiment intended for use in combination with a General Electric brand timer. At the conclusion of the summary distinction with regard to the secondary embodiment utilized in combination with an Intermatic brand timer will be given.

As stated above, the first element of the automatic light switching system of this invention comprises a receptacle means electrically connected to the circuit to be operated. The receptacle means further comprises manual switch means whereby the circuit can be operated between its "on" and "off" positions independent of any timing mechanism. The receptacle means further comprises outlet means electrically connected to the circuit to be operated.

The outlet means comprises a first receiver electrically connected to the circuit to be operated for transmitting electrical power to the "hot" prong of the automatic timer adjacent a neutral receiver for insertion of the corresponding neutral prong of the timer. Accordingly, whether or not the circuit is in its "on" or "off" position, electrical energy will pass into the timing circuit of the automatic timer so as to energize and operate the timer. The receptacle means further comprises a second receiver electrically connected to the circuit to be operated whereby the making of an electrical contact across the first and second receivers, through the automatic timer, will energize the circuit.

In order to accomplish the electrical contact across the first and second receivers of the receptacle means, an adapter means is provided.

The adapter means of the present invention comprises an insulated conductor. One end of the conductor comprises a first male connector removably attachable to the "hot" side of the timer's output receptacle. The other end of the conductor comprises a second male connector which is removably attachable to the second receiver means of the receptacle means. At this point it should be noted that the relative placement of the second receiver means and the configuration of the adapter means are such that when the adapter means is operatively mounted on the automatic timer the second male connector will be positioned so as to mate with the second receiver means when the timer is plugged into the receptacle. Then, by virtue of the standard timing circuit within the timer means, when the timer cycles to an "on " position, electrical energy will flow from the receptacle's first receiver, through the timer to the timer's output receptacle, from the "hot" side of the output receptacle through the adapter means conductor, and finally to the second receiver means thereby completing the electrical pathway to energize the circuit being operated.

Still with specific regard to the General Electric brand timer, the present invention contemplates structural design and orientation of the adapter means such that the second male connector presents a horizontal configuration to mate with a correspondingly oriented horizontal second receiver.

The present invention further contemplates that it may be desirable to place two receptacle means in substantially adjacent, parallel relationship to each other.

The invention would then further comprise bridge means removably disposable in electrical conducting relation between the adjacent receptacle means, and more particularly between the adjacent second receivers. One side of the bridge means would further comprise bridge outlet means formed thereon for receiving an automatic timer therein. Accordingly, a single timer would be utilized to operate two individual, but parallel, electrical circuits.

As previously stated, the only substantive difference between General Electric brand timers and Intermatic brand timers resides in which of the two prongs of the timing circuit are "hot." In order to preclude using the wrong timer with a particular circuit the construction for an Intermatic brand timer is such that the second male connector of the adapter means and the corresponding second receiver of the receptacle means are vertically oriented. Of course, corresponding internal wiring connections are made according to standard electrical procedures so as to provide the proper flow of current from the receptacle outlet means through the automatic timer means and adapter means in order to control the operation of the circuit.

It is therefor apparent that the automatic light switching system of the present invention can easily provide protective lighting, both inside and outside the home at extremely low cost. All that is required is a slight wiring modification of the existing lighting circuit, the purchase of a standard, commercially-available timer, and a suitable adapter for plugging the timer into the modified circuit. Use of the light switching system of the present invention will not only afford protection, but will also have the secondary effect of saving energy and dollars by regulating the operation of an existing electrical circuit.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
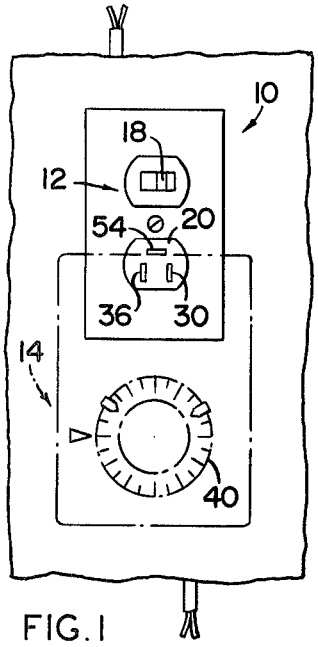
FIG 1 is a front plan view of the receptacle means of the present invention with the timer means shown in phantom to indicate its placement with regard to the receptacle means.

The present invention relates to an automatic light switching system generally indicated as 10 in the view of FIG. 1. With specific regard to the views of FIGS. 1, 2, 3, and 4, automatic light switching system 10 comprises, in comination, a receptacle means generally indicated as 12 electrically connected to the circuit to be operated, a plug-in automatic timer means generally indicated as 14, and an adapter means generally indicated as 16. As perhaps best illustrated in the views of FIGS. 1 and 6, adapter means 16 is operatively disposed on automatic timer means 14, and the resulting combination is inserted into receptacle means 12 so as to regulate the operation of the circuit to which receptacle means 12 is electrically connected, as will be set forth in greater detail below.

Figure 2:
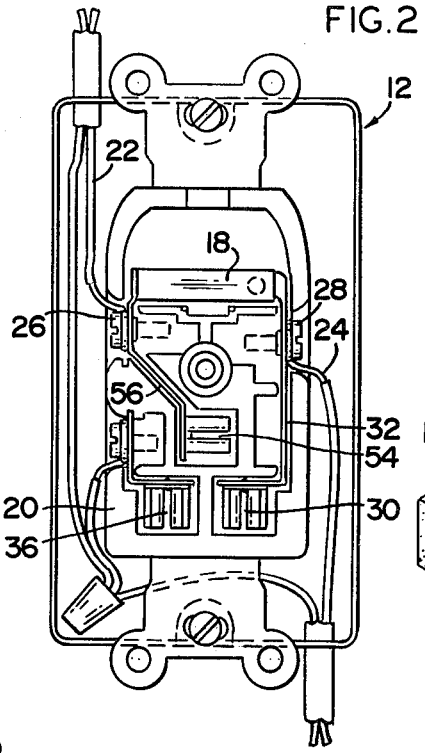
FIG. 2 is a plan view of the interior of a first embodiment of the receptacle means showing its manner of wiring into the circuit to be operated.
Figure 3:
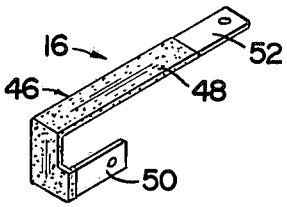
FIG. 3 is a perspective view of a first embodiment of the adapter means.

A preferred embodiment for receptacle means 12 is illustrated in the views of FIGS. 1 and 2. As shown therein receptacle means 12 comprises manual switch means 18 and outlet means 20. Manual switch means 18 comprises a standard on-off switch and is electrically connected to the circuit to be operated by conventional means such as electrical conductors 22 and 24 at contact points 26 and 28, respectively. As illustrated in FIG. 2 contact points 26 and 28 may comprise screws. Accordingly, manual switch means 18 may be utilized to regulate the operation of the electrical circuit independently of automatic timer means 14.

Figure 6:
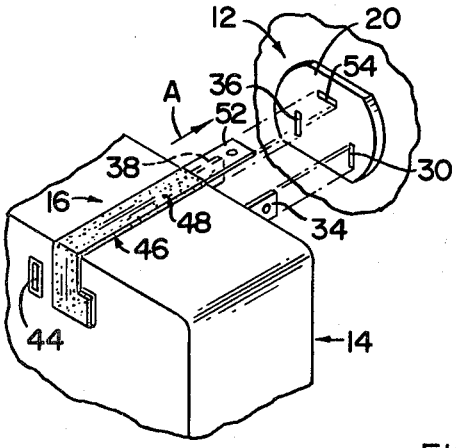
FIG. 6 is a fragmentary exploded view showing the attachment of a first embodiment for the timer means and adapter means into the corresponding receptacle means outlet.
Figure 7:
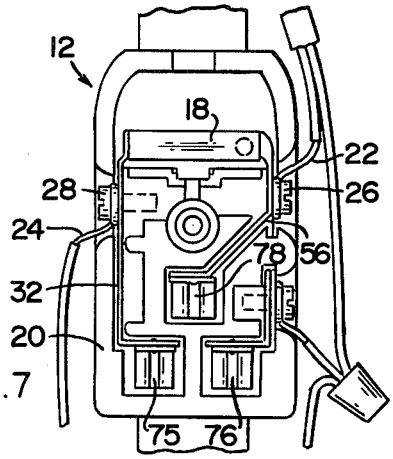
FIG. 7 is a front plan view of a second embodiment of the receptacle means showing the manner of its wiring into the circuit to be operated.
Figure 5:
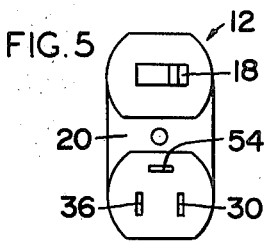
FIG. 5 is a plan view of a first embodiment of the receptacle means.
Figure 8:
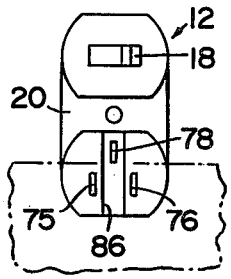
FIG. 8 is a front plan view of a second embodiment of the receptacle means showing placement of a second timer means thereon in phantom.

Still with regard to the preferred embodiment, outlet means 20 comprises a first receiver 30 electrically connected as by conductor strip 32 to the energized, or "hot" conductor 24 of the circuit to be operated. As best seen in the view of FIG. 6, automatic timer means 14 includes a first prong 34 which is removably insertable into first receiver 30 so as to obtain electrical energy for the operation of timer means 14. Of course, in order to complete the electrical circuit through timer means 14, outlet means 20 further comprises a neutral receiver 36, and timer means 14 includes a corresponding neutral prong 38. Accordingly, when prongs 34 and 38 of timer means 14 are inserted into their corresponding receivers 30 and 36 electricity passes from the circuit being operated into the timer means 14 so as to operate the timing circuit (not shown).

As most clearly seen in the illustration of FIG. 1, a dial 40 is provided on timer means 14 for regulating its operation according to the manufacturer's instructions. At this point it should be noted that the timer means 14 thus far described with regard to the preferred embodiment is one such as is commercially available under the General Electric brand name.

Figure 4:
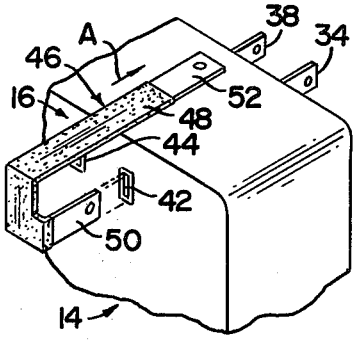
FIG. 4 is a fragmentary perspective view of the timer means for a first embodiment of the present invention illustrating the attachment of the corresponding adapter means thereto.

Attention is next specifically invited to the views of FIGS. 4 and 6. In these views it can be seen that timer means 14 further comprises an output receptacle 42 comprising a source of electricity electrically connected to and regulated by the timing circuit of timer means 14. That is to say, the timing circuit of timer means 14 will make electrical current available at output receptacle 42 at predetermined intervals according to the setting of dial 40. Of course, timer means 14 further includes a neutral output 44 which is unnecessary to the operation of automatic light switching system 10. Electrical energy from hot output 42 is utilized to complete and activate the circuit being operated as is described below.

Electrical energy from hot output 42 is conducted from timer means 14 to receptacle means 12 by adapter means 16. Adapter means 16 comprises an insulated conductor means 46 which is attachable to timer means 14 in the manner illustrated by directional arrow A. As most clearly seen in the view of FIG. 3, insulated conductor means 46 includes an insulating cover 48 disposed in surrounding relation to exposed portions of conductor means 46. A conductive first male connector 50 is formed at one end of conductor means 46 and is removably attachable to output receptacle 42. A second male connector 52 is formed at the other end of conductor means 46 and is removably attachable to receptacle means 12.

Considering once again the construction for receptacle means 12, attention is invited to the views of FIGS. 2 and 6 wherein receptacle means 12 is illustrated as further comprising a second receiver 54 electrically connected to the circuit to be operated as by second conductor strip 56.

Accordingly, when an electrical circuit is completed across first receiver 30 and second receiver 54 of outlet means 20, the circuit being operated will be energized without regard to the position of manual switch means 18. It is in this fashion that receptacle means 12, timer means 14 and adapter means 16 are utilized to control the on-off condition of the circuit.

Figure 10:
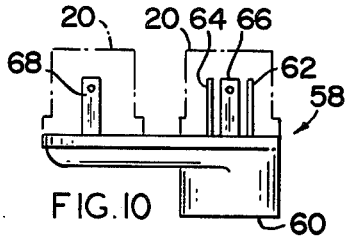
FIG. 10 is a top plan view of a first embodiment of the bridge means of the present invention.
Figure 11:
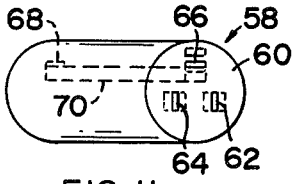
FIG. 11 is a front elevational view of the bridge means shown in FIG. 10 with interior details shown in broken lines.

Still with regard to the first embodiment of the automatic light switching system 10, attention is invited to the views of FIGS. 10 and 11. FIGS. 10 and 11 illustrate a preferred embodiment for the bridge means, generally indicated as 58, of the present invention. Bridge means 58 is utilized to regulate the operation of two individual circuits by a single timer means 14 and adapter means 16. Bridge means 58 is utilized to accomplish an electrical connection between two adjacent receptacle means 12 and more particularly between adjacent second receivers 54. One side of bridge means 58 comprises a bridge outlet means 60 formed thereon for receiving an automatic timer means 14 and its corresponding adapter means 16. Bridge means 58 further comprises bridge prongs 62, 64, 66 and 68 disposed thereon in interconnecting, conductive relation to the adjacent receptacle means 12. In accord with the detailed description given above, bridge prong 62 is inserted into first receiver 30; bridge prong 64 is inserted into neutral receiver 36; bridge prong 66 is inserted into second receiver 54; and bridge prong 68 is inserted into second receiver 54 of the second outlet means 20. As shown in phantom in FIG. 11, bridge prong 66 and bridge prong 68 are in direct electrical contact with each other by bridge conductor strip 70. Accordingly, a single timer means 14 having placed thereon the corresponding adapter means 16 may be utilized to regulate the operation of adjacent circuits.

Having thus far presented a detailed description for a first embodiment of the automatic light switching system 10, attention is now invited to the remaining views of FIGS. 7, 8, 9, 12 and 13 wherein a second embodiment is illustrated. In fact, the only substantive difference between the first embodiment and the second embodiment resides in the wiring of the timing circuit within the automatic timer means 14. The first embodiment is shown with regard to the General Electric brand timer means 14 which is constructed so that first prong 34 receives electrical energy and may therefore be termed the "hot" side of the circuit. In the second embodiment, such as may be commercially illustrated by an Intermatic brand timer, it is the left-hand prong 72 which receives current for operating the timing circuit of timer means 14. Similarly, right prong 74 is neutral. Then, in the second embodiment, outlet means 20 is electrically connected so that its energized first receiver 75 is on the relative left-hand side of receptacle means 12, and its neutral receiver 76 is on the right. Second receiver 78 of the second embodiment is in the same relative position with regard to outlet means 20, but it should be noted that its configuration has been altered to a vertical relationship as opposed to the horizontal relationship of first embodiment second receiver 54. This alteration in the configuration of second receiver 78 has been made so as to preclude the inadvertent attachment of an improper timer means 14.

Figure 9:
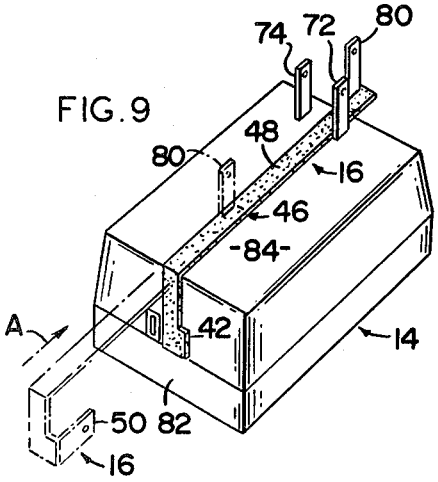
FIG. 9 is a prospective view of a second embodiment of the timer means including the second adapter means placed thereon.

In light of the reorientation of second receiver 78, a corresponding reorientation of adapter means 16 is shown in the view of FIG. 9. Therein it can be seen that the adapter means 16 is constructed so as to provide a second male connector 80 which is vertically oriented so as to allow its insertion into the second receiver 78.

It should also be noted that because of the placement of output receptacle 42 at the base 82 of this embodiment of timer means 14 a major portion of the adapter means 16 will lie along back 84 of timer means 14. A corresponding groove 86 is provided on outlet means 20 to receive this major portion of adapter means 16 therein.

Inasmuch as the remaining elements of the second embodiment of automatic light switching system 10 are identical to those included in the first embodiment, these remaining elements have been identified by reference numerals corresponding to those utilized in the detailed description of the first embodiment.

Figure 12:
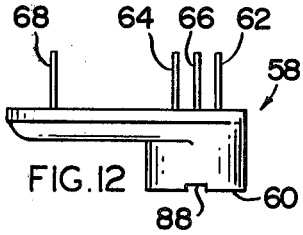
FIG. 12 is a top plan view of a second embodiment of the bridge means of the present invention.
Figure 13:
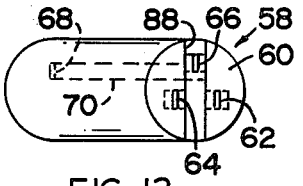
FIG. 13 is a front plan view of the bridge means shown in FIG. 12 with interior details shown in broken lines.

The views of FIGS. 12 and 13 illustrate a second embodiment for bridge means 58 to be utilized in combination with the second embodiment of automatic light switching system 10. Except for the addition of a bridge groove 88 on the face of bridge outlet means 60, the construction of the second embodiment is identical to that of the first embodiment shown in FIGS. 10 and 11. Accordingly, similar reference numerals have been utilized.

It will thus be seen that the objects set forth above, among those made apparent from the preceding description, are efficiently attained and since certain changes may be made in the above constructions without departing from the scope of the invention, it is intended that all matter contained in the above descriptio or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An automatic light switching system of the type primarily intended for use in operating an electrical light circuit, said switching system comprising, in combination: a receptacle electrically connected to the circuit to be operated, said receptacle comprising a manual switch and an outlet; wherein said outlet comprises a first receiver which is electrically connected to the energized side of the circuit to be operated and a second receiver disposed in predetermined, spaced relation to said first receiver, said second receiver being connected to the circuit to be operated, whereby making an electrical contact across said first and second receivers will energize the circuit; a plug-in automatic timer comprising an output receptacle disposed thereon and a removable adapter attachable to said output receptacle in interconnecting, conductive relation between said timer output receptacle and said outlet; wherein said adapter comprises an insulated conductor, one end of said conductor comprising a first male connector removably attachable to said output receptacle and the other end of said conductor comprising a second male connector removably attachable to said second receiver, said adaptor utilized to convert a conventional wall plug timer, which completes a circuit to an appliance at predetermined intervals to a timer which completes the circuit to be operated at predetermined intervals when said manual switch is in the off position.

2. An automatic light switching system as in claim 1 wherein said timer comprises a first prong removably insertable into said first receiver in electrical contact therewith, whereby electricity to operate said timer is received.

3. An automatic light switching system as in claim 2 wherein said output receptacle comprises a source of electricity, said output receptacle being electrically connected to and regulated by the timing circuit of said timer.

4. An automatic light switching system as in claim 1 further comprising a bridge removably disposable in electrical conducting relation between adjacent ones of said receptacle, said bridge including a bridge outlet thereon, whereby a single one of said timer and said adapter may be attached to said bridge outlet to operate the circuits of said adjacent ones of said receptacle.

5. An automatic light switching system as in claim 1 wherein said switch comprises an on-off switch, whereby the circuit may be energized independently of said timer.

* * * * *